United States Patent [19]

Lindermann

[11] 4,184,535

[45] Jan. 22, 1980

[54] COOLING CHAMBER CLOSURE MEMBER

[75] Inventor: Herbert Lindermann, Duisberg, Fed. Rep. of Germany

[73] Assignee: Fried. Kruff Gesellschaft mit beschränkter Haftung, Essen, Fed. Rep. of Germany

[21] Appl. No.: 927,355

[22] Filed: Jul. 24, 1978

[30] Foreign Application Priority Data

Jul. 26, 1977 [DE] Fed. Rep. of Germany ..... 2733568

[51] Int. Cl.[2] ..... B22D 11/124

[52] U.S. Cl. ..... 164/442; 164/444

[58] Field of Search ..... 164/442, 444, 441, 447, 164/448; 49/373; 160/107

[56] References Cited

U.S. PATENT DOCUMENTS

| | | | |
|---|---|---|---|
| 2,607,408 | 8/1952 | Bascom | 160/37 |
| 2,747,245 | 5/1956 | Junghans | 164/444 X |
| 3,789,913 | 2/1974 | Stellmacher | 164/444 |
| 3,995,683 | 12/1976 | Guyot et al. | 164/442 |

*Primary Examiner*—Robert D. Baldwin

*Attorney, Agent, or Firm*—Spencer & Kaye

[57] ABSTRACT

In a continuous casting system for producing metal strip, or the like, and including a chamber through which such strip is conveyed and which is provided with an opening for passage of a railbound maintenance carriage traveling parallel to the metal strip in the chamber, there is provided a closure member for closing the opening, which member is in the form of a cover, is provided with supporting undercarriages movable on the same rails as the carriage, and is disposed within the chamber.

9 Claims, 5 Drawing Figures

3
9
11
13
14
15
16
17
18
19
20
21
22
23
24
25
26
27

COOLING CHAMBER CLOSURE MEMBER

BACKGROUND OF THE INVENTION

The present invention relates to a closure member for an opening disposed near the lower end of the cooling chamber of a continuous casting system or the like, which opening serves for the passage of a railbound carriage which moves parallel to the cast material and is provided for the purpose of maintenance.

During casting of steel in the form of a band or strip, hardening of the steel strip along one part of the strip guiding rack is enhanced by spraying large quantities of water onto it from spraying nozzles. In addition to the strip, strip guiding rollers which are in direct contact with the surface of the strip are cooled as well. In order to shield this so-called wet region from the lower portion of the guiding rack, where the guide rollers are cooled from the inside, and to protect this part against moisture and steam, a so-called cooling chamber is employed which must be provided with a closable opening so that maintenance work, such as the exchange of driving frames and guide roller segments, can be performed.

It is known to keep these openings closed during the casting process by means of wing, drop, sliding or rolling gates. These types of closure members are installed in casting systems in which the driving frames and guide roller segments are installed and are removed by means to bridge cranes which are disposed beneath the pouring platform and moved in a direction transverse to the casting direction, as well as in systems in which the driving frames and guide roller segments are exchanged by means of carriages equipped with driving frame and segment exchanging devices which move on rails parallel to the length of the steel strip.

While the known wing and sliding gates are generally used in conjunction with bridge cranes and are then generally opened and closed manually, rolling gates as well as drop or drop and fold gates, which are generally used in conjunction with the movable carriage equipped with the driving frame and segment exchange devices, are usually opened and closed by electromechanical or hydromechanical drives.

The known closure members have the drawback that they can not always create tight seals due to uneven contact with the surfaces intended for this purpose. The associated sealing devices are therefore usually very complicated and and expensive. Sealing is particularly difficult in the region of the rails for the maintenance carriage. Thus sealing of this region with the known drop or drop and fold gates requires special, manually actuated, small wing gates.

SUMMARY OF THE INVENTION

It is therefore an object of the present invention to provide a closure member of the above-mentioned type which makes possible rapid closing and opening with a secure seal, utilizing structurally simple means.

These and other objects according to the invention are achieved by provision of a closure member for closing an opening provided in the wall of a chamber for passage of a carriage traveling along rails extending through the opening and into the chamber, which closure member is in the form of a cover for the opening, is disposed inside the chamber, and includes undercarriages which travel on the rails.

The present invention has the advantage that the cover-like form of the closure member produces a secure seal by means of a simple grooved seal which can be produced with the simplest means. The easily obtained seal is also effective for the region of the rails which extend closely adjacent the closure member. A further advantage provided by the invention is that the closure member does not require its own drive.

DESCRIPTION OF THE PREFERRED EMBODIMENTS

Figure 2:
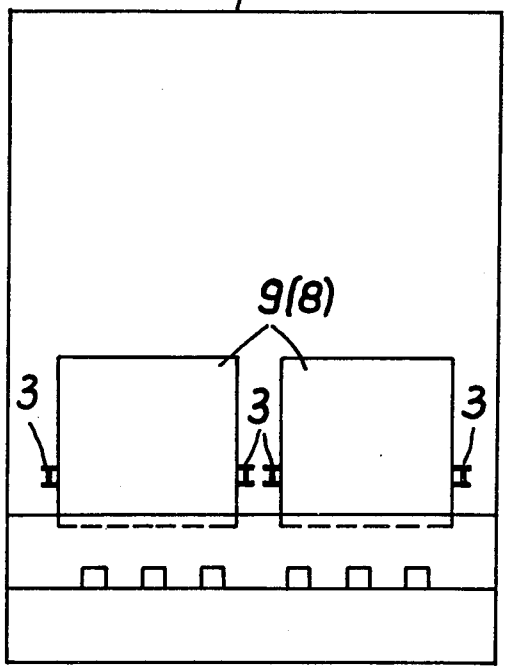
FIG. 2 is a cross-sectional view along the line II—II of FIG. 1 with parts of the system eliminated.
Figure 1:
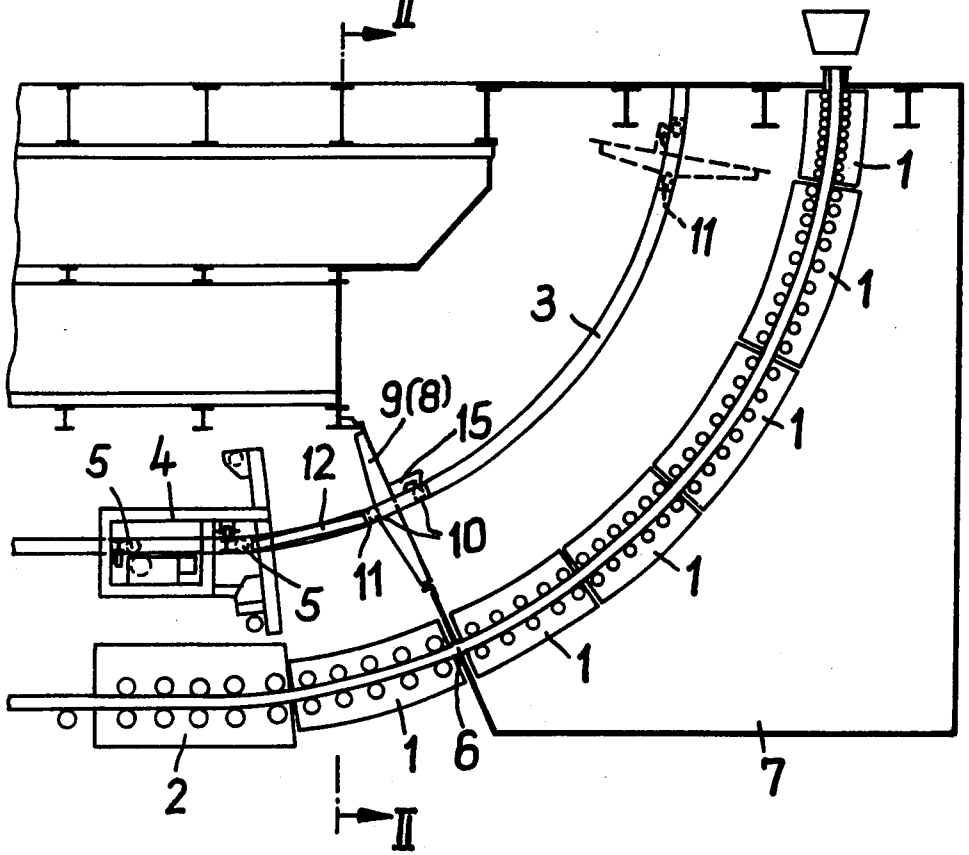
FIG. 1 is an elevational, cross-sectional view of the cooling chamber and part of subsequent units of a system incorporating a preferred embodiment of the invention.

The casting system shown in FIGS. 1 and 2 is equipped with two laterally spaced strip guiding frames each composed of a plurality of guide roller segments 1 and drive frames associated with the guiding frames, but not shown, as well as strip transport guiding machines 2 and pairs of rails 3 arranged parallel to the strip guiding frames. A maintenance carriage 4 provided with a driving frame and guide roller segment exchanging device and its own drive, all known per se, moves in each pair of rails on wheels 5.

Figures 3, 4, 5:
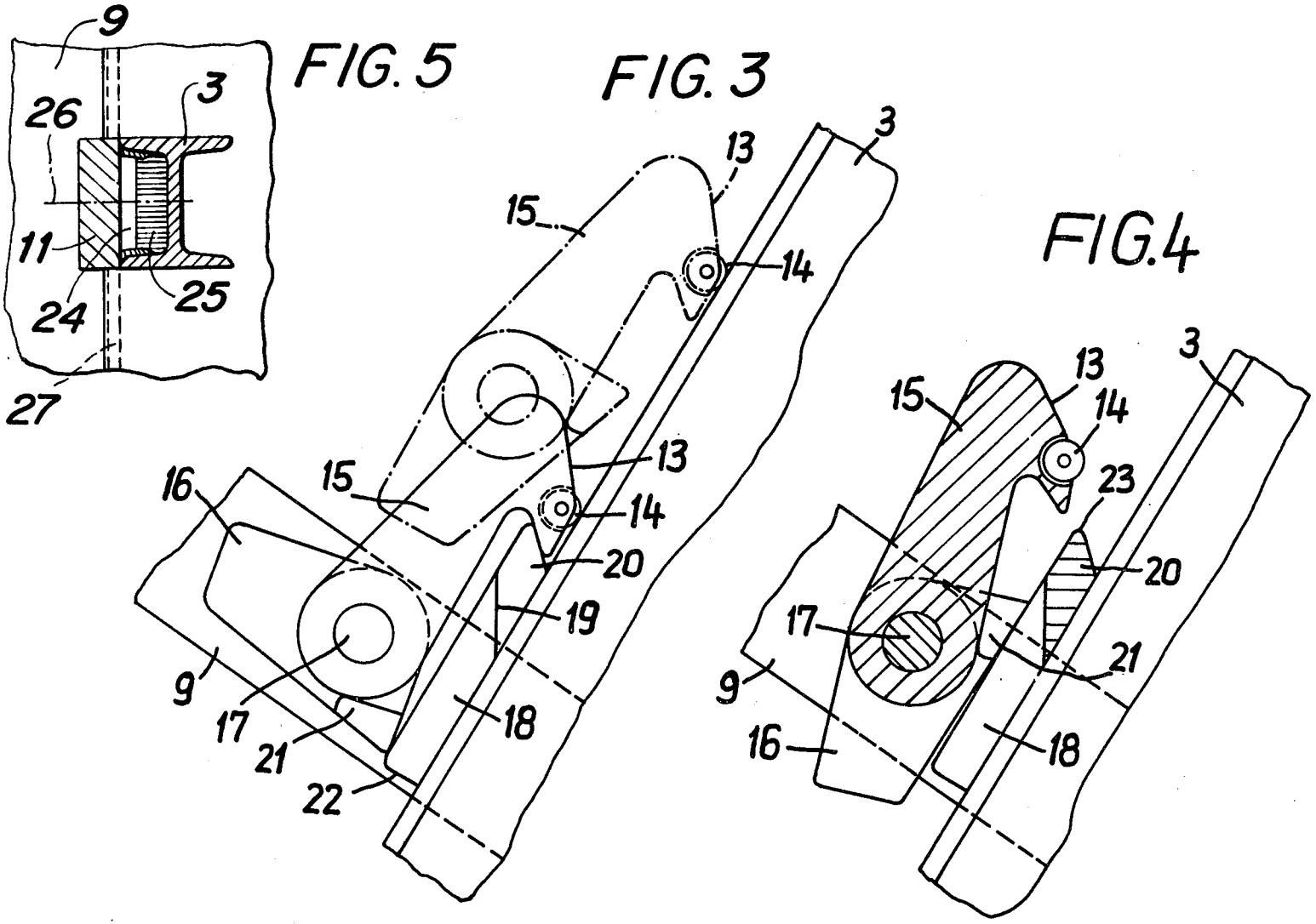
FIGS. 3 and 4 are detail views of a preferred embodiment of locking elements of a closure member according to the invention in three different positions.
FIG. 5 is a detail view of an embodiment of the seals of the closure member in the region of the rails.

Near the lower end, and near the strip discharge openings 6 of a cooling chamber 7 there are provided two openings 8 which can each be closed from the inside by means of a respective cover-like closure member 9. The closure member 9 is constituted by a structurally reinforced, torsion resistant steel plate and is provided at each side with respective undercarriages 11 which have four wheels 10 each and move on rails 3. The rails 3 are formed as I, or double-T profiles, as shown in FIG. 2. In the region of the rails, the closure member is provided with a simple labyrinth seal as shown in FIG. 5. A brush-like seal member 24 provided with flexible bristles 25 pivotable about an axis 26 is fastened to the undercarriages 11 and gearing together with the rails 3. The rim zones of the openings 8 are bordered with a packing fence 27 which corresponds with the rim zones of the closure members 9.

During maintenance work, such as the exchange, or replacement, of a drive frame or guide roller segments, the carriage 4 pushes the closure member 9 which, in the closed position shown in FIG. 1, is automatically sealed by the force of gravity, via an intermediate spacer 12 in front of the carriage, and thus permits entry of the carriage into the cooling chamber 7. When only a single guide roller segment is being replaced, closure member 9 is automatically locked in a "parked position" slightly above the location in question. For maintenance work requiring more time, closure 9 is arrested in an upper position, shown in dot-dash lines in FIG. 1, for the duration of the work..

The fixing and releasing of closure member 9 by means of an automatic locking device will be described in detail below with reference to FIGS. 3 and 4.

The illustrated locking device includes a catch 13 carried at the end of an arm 15 and provided with a roller 14, and an unlocking lever 16, both the arm 15 and lever 16 being pivotally fastened to the side of closure member 9 via a bearing bolt 17. The unlocking lever 16 is also rotatably mounted on bearing bolt 17. To provide points of engagement, locking plates 18 are connected to the rails 3 at the predetermined parking positions to which closure member 9 can move within cooling chamber 7. In order to be able to make subsequent changes in these parking positions, it is advisable to make the connections to rails 3 releasable.

Each locking plate 18 includes a laterally protruding latching cam 20 presenting a camming surface 20 and an upper protruding edge 23.

In operation, as a parking position is being approached by closure member 9, the catch 13 first runs up against the camming surface 19 of the laterally protruding latching cam 20 on locking plate 18. Roller 14 then rides up surface 19 so that arm 15 is deflected upwardly until catch 13 has passed beyond the locking plate 18, whereupon the arm drops under its own weight onto rails 3 behind cam 20 of locking plate 18. After a slight movement backwards, the parking position is thus reached, this being shown in solid lines in FIG. 3, and the closure member 9 is secured against backward movement.

In the meantime, the unlocking lever 16 will have performed the following movement: simultaneously with the contact of the catch 13 against the surface 19, an abutment cam 21 attached to the unlocking lever 16 will have abutted against the lower, or front, face 22 of locking plate 18 and will thus be pivoted so that it comes to rest on the face of locking plate 18 which faces away from rail 3, in the position shown in solid lines in FIG. 3.

If the cooling chamber closure member 9 is now to leave the parked position shown in solid lines in FIG. 3, and is to be lowered, it is unlocked as follows: by operating carriage 4, the closure member 9 is moved forward by a small amount, i.e. is raised, until abutment cam 21 has passed completely beyond locking plate 18. Due to its greater weight at the side of pivot 17 facing away from abutment cam 20, the unlocking lever 16 now pivots back to its normal position, shown in dot-dash lines in FIG. 3, so that finally cam 21 rests against the underside of arm 15 and arm 15 and lever 16 are in the "readiness to unlock" position shown in dot-dash lines in FIG. 3.

If now closure member 9 is retracted, i.e. lowered, the abutment cam 21 runs against the upper protruding edge 23 of catching cam 20 so that cam 21 and, together therewith, arm 15 are pivoted upwardly so that catch 13 can freely pass over locking plate 18 when the closure member 9 is moved back further, as shown in FIG. 4. After locking plate 18 has been passed completely, arm 15 and unlocking lever 16 drop back to their respective normal positions.

Advantageously, carriage 4 can itself be equipped with the same locking device. The new closure member can of course also be used for chambers of other systems of similar form.

It will be understood that the above description of the present invention is susceptible to various modifications, changes and adaptations, and the same are intended to be comprehended within the meaning and range of equivalents of the appended claims.

What is claimed is:

1. A closure member for closing an opening provided in the wall of a chamber of a system for casting metal strip conveyed through the chamber, the opening being provided for passage of a carriage traveling along rails extending through the opening and into the chamber, said closure member being in the form of a cover for the opening, being disposed inside said chamber, and comprising undercarriages which travel on said rails.

2. An arrangement as defined in claim 1 wherein said closure member is movable by the carriage, and the carriage is provided with a drive.

3. An arrangement as defined in claim 1 further comprising at least one engaging locking device for fixing said closure member in any selected one of a plurality of positions within said chamber.

4. An arrangement as defined in claim 3 further comprising latching means for said locking device mounted on at least one of said rails at said positions.

5. An arrangement as defined in claim 4 wherein said locking device is arranged to be automatically engaged and disengaged mechanically in response to movement of said closure member relative to said latching means.

6. An arrangement as defined in claim 1 wherein said chamber is a cooling chamber said rails extend parallel to the direction in which the metal strip is so conveyed, and the carriage is a maintenance carriage.

7. In a system for casting metal strip and including a cooling chamber having at least one end wall provided with an opening, means in the chamber for conveying such strip therethrough, and rails extending through the opening and into the chamber for supporting a carriage arranged to travel through the opening and into the chamber, the improvement comprising a closure member in the form of a cover for said opening, said closure member being disposed inside said chamber and being provided with undercarriages which support said cover member on said rails and permit said cover member to travel along said rails within said chamber.

8. An arrangement as defined in claim 7 wherein said carriage is provided with means engageable with said cover member for advancing said cover member along said rails.

9. An arrangement as defined in claim 8 wherein said rails extend parallel to the direction in which metal strip is conveyed through said chamber, and said carriage is a maintenance carriage.

* * * * *